United States Patent [19]

Casey

[11] 4,147,813

[45] Apr. 3, 1979

[54] METHOD OF MAKING A SPLINTER-FLOCKED FABRIC FROM A MULTIFILAMENT TOW

[75] Inventor: James P. Casey, Seekonk, Mass.

[73] Assignee: Microfibres, Inc., Pawtucket, R.I.

[21] Appl. No.: 805,167

[22] Filed: Jun. 9, 1977

Related U.S. Application Data

[63] Continuation of Ser. No. 676,934, Apr. 14, 1976, abandoned, which is a continuation of Ser. No. 545,116, Jan. 25, 1975, abandoned.

[51] Int. Cl.[2] ..... B05D 1/04; B05D 1/06; B05B 1/00; B05B 1/08

[52] U.S. Cl. ..... 427/27; 427/200; 427/206; 427/258; 427/288; 427/352

[58] Field of Search ..... 427/200, 27, 206, 258, 427/288, 352

[56] References Cited

U.S. PATENT DOCUMENTS

| | | | |
|---|---|---|---|
| 2,255,779 | 9/1941 | Kent | 91/70 |
| 3,798,048 | 3/1974 | Brody | 117/17 |

*Primary Examiner*—Bernard D. Pianalto
*Attorney, Agent, or Firm*—Miller & Prestia

[57] ABSTRACT

Method and apparatus for making a splinter-flocked fabric from a multifilament tow. The tow is formed into a wide, flat ribbon, the tow is impregnated with a size liquid in order to adhere the filaments to each other, and the tow is cut into flock fibre lengths while in the form of a wide, flat ribbon, thus producing flock fibre bands. The bands are broken up into a multiplicity of splinters of controlled denier, the splinters are electrostatically flocked on a substrate, and the size is then removed as by washing with warm water, to produce a splinter-flocked fabric.

13 Claims, 7 Drawing Figures

METHOD OF MAKING A SPLINTER-FLOCKED FABRIC FROM A MULTIFILAMENT TOW

This is a continuation of application Ser. No. 676,934, filed Apr. 14, 1976, and now abandoned; which is a continuation of Ser. No. 545,116, Jan. 25, 1975, and now abandoned.

BRIEF DESCRIPTION OF THE INVENTION

This invention relates to a method and apparatus for making a splinter-flocked fabric, and also relates to the production of flocked fabrics wherein some of the fibres are splinter-flocked and others are individually flocked.

BRIEF DISCUSSION OF THE PRIOR ART

It is conventional to manufacture flocked fibres by using an electrostatic flocking chamber into which individual flock-cut fibres are fed. These fibres, electrostatically energized, impinge substantially vertically upon the surface of the substrate, and are normally held in this position by an adhesive previously applied to such surface. The resulting products, after drying the adhesive, have found considerable utility for a variety of end uses, such as for fabrics, wall papers, outerwear, etc. Ordinarily in such prior art processes the flocked fibres are individual fibres, and they tend to distribute themselves quite uniformly over the surface of the substrate, each fibre standing substantially vertically from the surface of the substrate and parallel to and equally spaced with respect to all of its neighboring fibres.

The patent to Kent U.S. Pat. No. 2,255,779 discloses a procedure for flocking pile in which long pile products are produced, such as artificial furs and plushes, although in some cases shorter fibres may also be produced. In accordance with the disclosure of Kent, the fibres can be sized together in a manner to provide either a group of threads or an individual thread comprising a group of fibres. A special adhesive is applied to the substrate, and the sized pile is then flocked onto the substrate. It seems clear from his disclosure that Kent had in mind a standard mechanical flocking process, and he did not suggest the use of electrostatic flocking wherein the fibres are impinged upon the substrate under the influence of a high voltage field.

It was also pointed out by Kent that sizing is a great aid in the utilization of longer cotton and wool fibres, but that in the absence of such sizing, rayon or hair function much better than cotton or wool unless the cotton or wool be cut very short. Particularly, Kent points out that in the longer lengths of one inch or longer, it is helpful to size the fibres.

OBJECTS OF THE INVENTION

It is an object of this invention to provide a commercially economical and practical way of making a novel and distinctive flocked suede or flocked fibre product from a textile tow, which is a collection of a very large number of fibres, such as a denier of 50,000 to 600,000, for example. Still another object is to provide a method wherein flocking may be utilized to produce a product having groups or clumps of flocked fibres, which product has surprising similarity in physical appearance to natural suede, for example.

Still another object of this invention is to provide a method for making a flocked synthetic suede product having excellent surface properties but which requires a smaller amount of flocked fibres on the substrate. Other objects and advantages of this invention, including the simplicity and economy of the same, and the wide variety of different products that can be made while utilizing its principles, will further become apparent hereinafter and in the drawings.

DRAWINGS

DETAILED DESCRIPTION OF THE INVENTION

Figure 1:
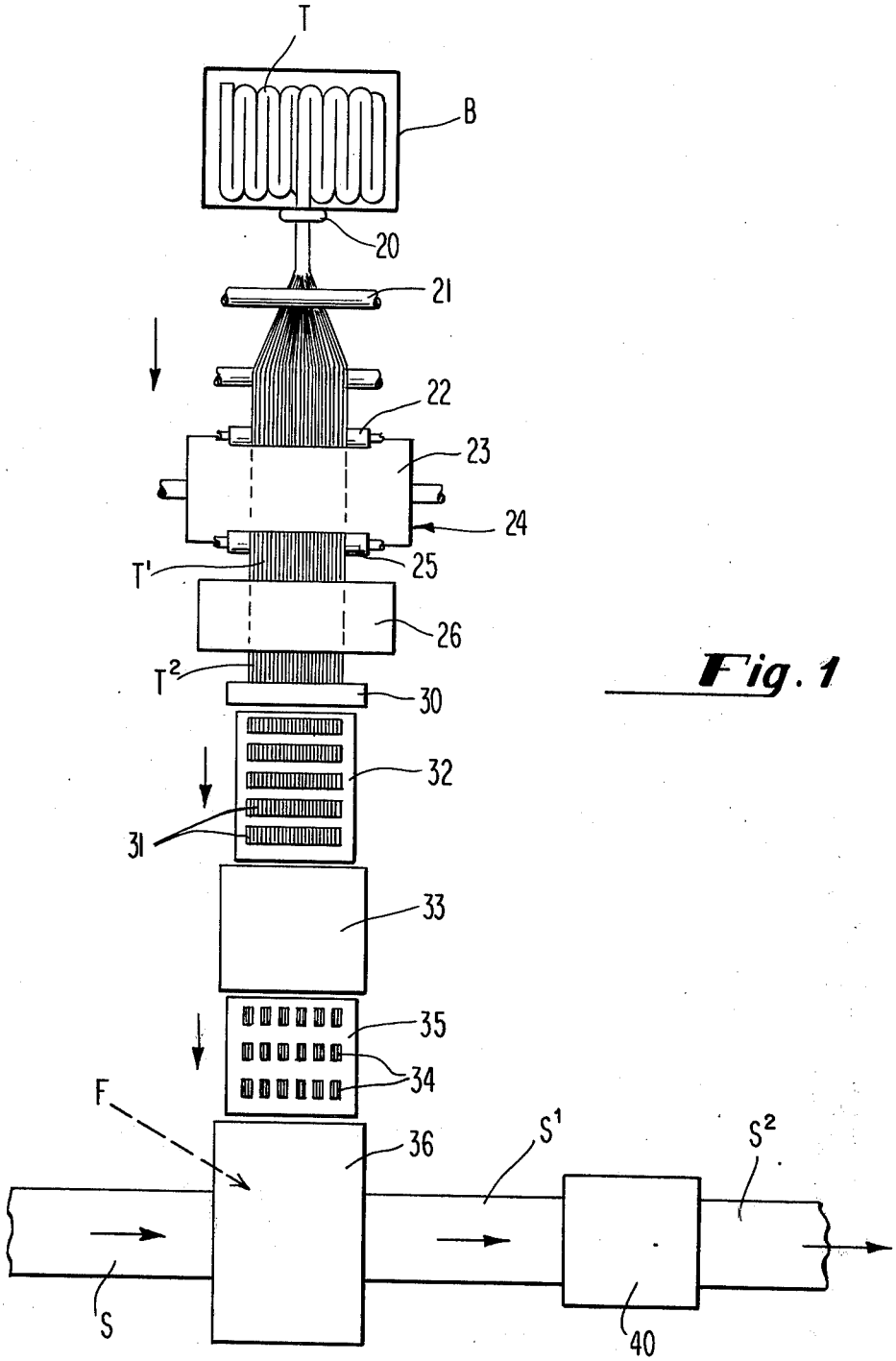
FIG. 1 is a schematic plan view showing a method utilizing features of this invention.

Although this invention will now be described in specific terms, having reference to the particular forms of the invention selected for illustration in the drawings, it will be appreciated that the invention may be practiced in a wide variety of forms, and that the specific terms hereinafter used in this specification are not intended to limit the scope of the invention, which is defined in the appended claims.

Turning now to FIG. 1 of the drawings, the starting material which is utilized in accordance with this invention is a synthetic multifilament tow T, which is usually delivered in a packaged or snaked-down arrangement within a tow box B. This tow consists of a multiplicity of individual filaments arranged substantially parallel to each other, but at random, and may have a denier ranging from a rather low denier of perhaps 10,000 more or less, all the way up to a very heavy denier tow, such as a tow having a denier of 500,000 or even more. Further, the denier per filament may vary considerably, but it is preferably a substantially uniform denier per filament throughout the tow. Typical deniers per filament range from 1 to 5, for example. Similarly, the tow which is used as the starting material in accordance with this invention may be a continuous synthetic multifilament tow of any of a wide variety of synthetic materials such as rayon, nylon, acrylic, polyester, etc. Highly desirably, although not necessarily, the tow may be specially wrapped in accordance with the teachings of the Rosenstein et al U.S. Pat. No. 3,675,409, granted to Hartford Fibres Ltd. of Kingston, Ontario, in order to maintain the tow in a compact condition within the tow box B and in order to facilitate its ready and rapid removal from the box without tangling with any of the adjacent lengths of tow within the box. As will be apparent from FIG. 1, the tow T is continuously drawn out of the box and passed through a pot eye 20 which serves as a tow guide, and is then passed over one or more tow flattening bars 21, which serve to change the cross-section of the tow from a generally circular cross-section to a flattened tow ribbon. The presence of the helical wrapping yarns mentioned in the aforesaid U.S. Pat. No. 3,675,409 does not interfere with such flattening operation, because they are loosely helically wrapped.

After having been flattened into a wide ribbon, the tow T is then passed over a feed roll 22 and under an immersion roll 23 in a size box 24. The tow becomes saturated with a liquid size solution, which may be starch, carboxymethyl cellulose, or a wide variety of other well known water-soluble sizes. The tow then continuously emerges from the size box 24 passing over the exit roll 25, producing the sized tow ribbon T', which is then conducted through the dryer 26 in order to dry the size in a manner to adhere all of the filaments in the tow ribbon to all of its adjacent filaments, producing a flat, solid ribbon-like product $T^2$.

The number 30 designates a guillotine-type flock cutter which has a knife edge which reciprocates up and down at a rapid rate, continuously chopping the advancing solidified sized tow $T^2$ into a plurality of adhered bands 31 of cut tow fibres. These are passed continuously on a conveyor belt 32 to a mill 33, in which the bands 31 are gently beaten or rubbed together in order to break them up partially. This is an important and critical feature in accordance with this invention. The extent to which the bands 31 are milled, and are partially broken up, is a critical feature of this invention. If they are not broken up sufficiently to produce a multiplicity of splinters which have appropriate shape and weight, their excessive weight interferes with efficient electrostatic flocking in a subsequent step. If the bands 31 are broken up to an excessive degree, the resulting splinters do not contain a sufficient number of fibres that are still adhered to one another, and in the subsequent electrostatic flocking operation they act more like individual flocked fibres, rather than like splinters.

Accordingly, in accordance with this invention it is important to regulate the operation of the mill 33 to break up the cut tow fibre bands 31 to form flock splinters 34 which preferably have a total denier per splinter in the range of 30 to 450, depending upon the effect and length of fibre desired.

The partially opened-up bands or splinters of controlled denier 34 are passed on the conveyor belt 35 to an electrostatic flocking chamber 36. A substrate S, which may be a fabric or a flexible sheet of almost any kind, carrying on one or more of its surfaces an adhesive coating, is also fed continuously into the chamber 36. As the substrate passes through the electrostatic flocking chamber 36, the flocked splinters 34 are subjected to the influence of the electrostatic field and are impinged substantially perpendicularly upon the surface or surfaces of the substrate S, forming the flocked fabric. The splinter-flocked fabric S' is then passed through a warm water wash tank 40, in a manner to wash out the size that was applied in the size box 24, to produce the splinter-flocked product $S^2$.

The details of construction and operation of the electrostatic flocking chamber are not shown, since a wide variety of different electrostatic flocking chambers may be used. However, the patent to Walsh U.S. Pat. No. 3,678,894 and the patent to Hawkins U.S. Pat. No. 3,426,729 are representative of typical electrostatic flocking chambers suitable for the practice of this invention.

It will be noted in FIG. 1 that optionally it is possible to introduce into the electrostatic flocking chamber, concurrently with the splinters 34, standard flock fibres F which become uniformly distributed with respect to the splinter flocks 34, within the electrostatic flocking chamber, and which are substantially uniformly deposited upon the substrate S, in a manner to provide a product having mixed splinters and individual flock fibres. The regular flock which is mixed with the splinters can be of the same or different chemical composition, so that in subsequent piece dyeing two or more colors may be obtained.

Figure 2:
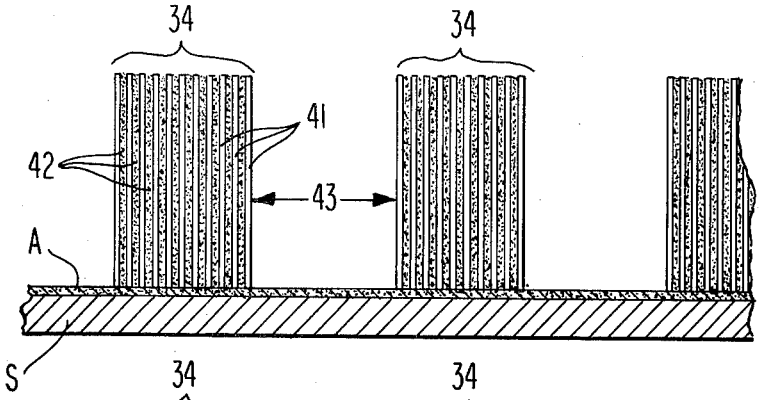
FIG. 2 is an enlarged sectional view of a splinter-flocked fabric produced at an intermediate stage of the process of production.

FIG. 2 shows a typical splinter-flocked product in accordance with this invention, having a substrate S and an adhesive layer A, together with splinters 34 composed of a multiplicity of flock-cut fibres 41 having intervening, adhered portions of size 42, all adhered as a bundle to the adhesive A. It will be apparent from FIG. 2 that the splinters 34 are spaced from one another on the substrate. The provision of such an intervening space 43 is an important and advantageous feature of this invention, and is achieved by controlling the rate of feed of flock splinters 34 with respect to the rate of speed of the substrate S, into the electrostatic flocking chamber 36. The influence of the electrostatic field within the chamber 36 tends to space the splinters substantially uniformly from each other so that they are deposited in the manner appearing in FIG. 2.

Figure 3:
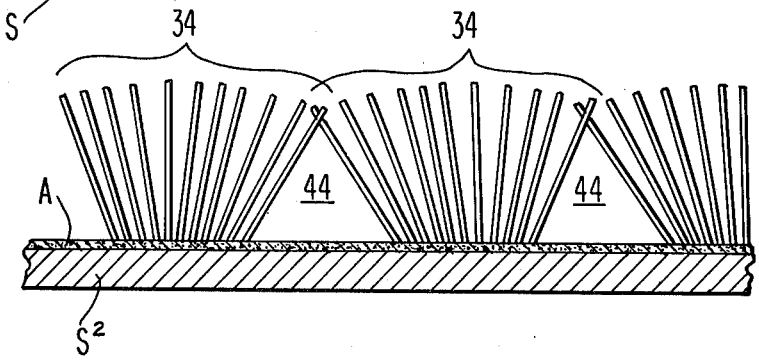
FIG. 3 is a view similar to FIG. 2, showing the same splinter-flocked fabric in a subsequent stage of its production.

FIG. 3 shows the splinter-flocked product $S^2$, which is achieved by applying a warm water wash to remove the size from the flocked fabric appearing in FIG. 2. The ends of the fibres 41 tend to fan out, meeting with each other and possibly even tangling somewhat at the areas where the fibres 41 from one splinter 34 merge with the fibres 41 from the adjacent splinter 34. In this manner, a tightly packed base is provided, having an outwardly flaring tuft, and having intervening air spaces 44 between the tightly packed bases of the splinters 34. In this manner excellent coverage is obtained with the use of a minimum weight of flocked fibres. If all of the flock were composed of individual fibres, it would not be possible to provide the intervening air spaces 44, which are highly advantageous not only in saving cost but in providing a fabric or material of superior handling quality.

Figure 5:
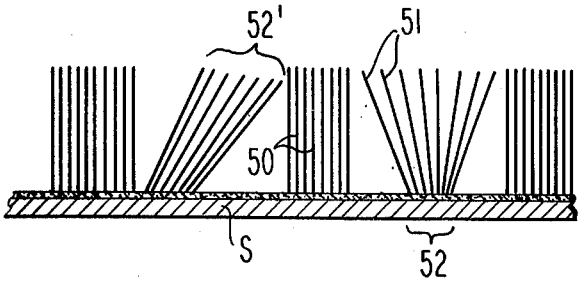
FIG. 5 is an enlarged sectional view taken as indicated by the lines and arrows V—V which appear in FIG. 4.
Figure 4:
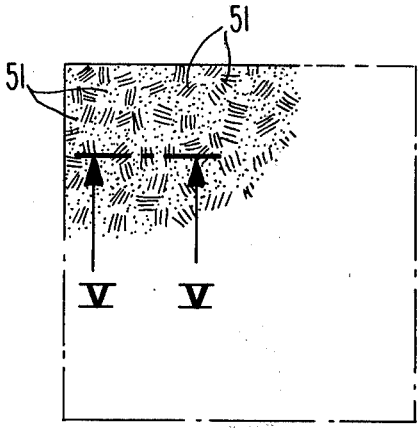
FIG. 4 is a face view of another form of splinter-flocked fabric comprising a synthetic suede.

FIGS. 4 and 5 show a typical product obtained by electrostatically flocking a mixed splinter-flock and individual flock. The individual flocked fibres 50 are substantially equally spaced and parallel to each other, whereas the fibres 51 resulting from the use of flock splinters having compacted bases 52 tend to fan out upwardly away from the substrate S. Further, as shown in FIG. 5, the bundles or splinters, because of their substantial weight, do not always impinge exactly perpendicularly upon the substrate S during the electrostatic flocking operation and for that reason one bundle 52' as shown in FIG. 5 is shown as being inclined at an angle to the perpendicular. This produces a highly desirable appearance in the final product—one remarkably similar to natural suede which, because of the particular nature of the manner in which animal grows, contains a wide variety of substantial irregularities with respect to the growth of the nap, resulting in small irregularities, bristles, tufts, etc. This effect is particularly enhanced by providing the splinter bundles 52 in a longer fibre length than the individual fibres 50.

Figure 7:
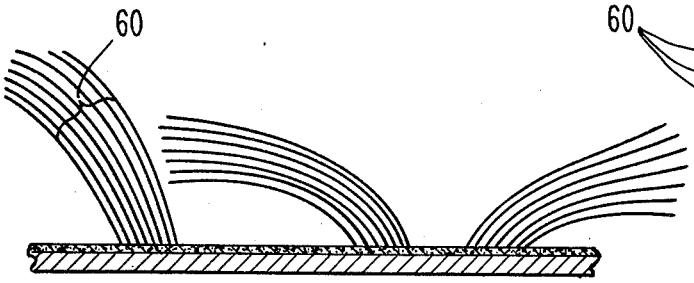
FIG. 7 is an enlarged sectional view taken as indicated by the lines and arrows VII—VII which appear in FIG. 6.
Figure 6:
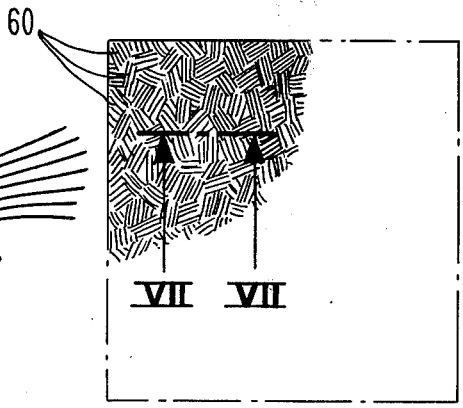
FIG. 6 is a face view of another form of synthetic suede produced in accordance with this invention.

FIGS. 6 and 7 show another form of the invention, utilizing rather long splinters 60, preferably composed of rayon, which splinters tend to bend over easily when subjected to slight compression or even crushing by hand. Such synthetic suedes or fabrics tend to develop a brilliant sheen, having a particularly pleasing surface effect.

It will be appreciated that a wide variety of different products having different effects may be obtained. One of the outstanding products is a strikingly life-like synthetic suede product, having bristles remarkably resembling those of natural suede. Another product, as referred to in connection with FIGS. 6 and 7, is a suede-like product having a brilliant sheen, which sheen appears to travel from area to area on the surface of the product, when the product is flexed even slightly. Still another type of product having a specially beautiful surface appearance includes products composed of splinter-flocks which have been dyed prior to the flocking operation in different colors, so that two colors or more can be blended substantially uniformly with one another, but which after washing with warm water nevertheless retain their identities as individual splinters, thus providing the appearance of individual tufts having predetermined tuft colors. It will be understood that any number of different types, deniers and fibre lengths may be combined with each other in the electrostatic flocking operation, and that they tend to distribute themselves substantially uniformly over the surface of the substrate during the electrostatic flocking operation. The extent to which such distribution becomes on-uniform can be controlled, however, by controlling the denier and fibre length of the splinters. A wide variety of other changes may be made, as will become apparent.

It will also be appreciated that the splinters 34, because of the manner in which they are formed in the mill 33, are not necessarily all of the same size or denier. Indeed, because of the random nature of the breaking up of the wide cut flock tow bands, there is a random distribution of sizes of the bundles with some being considerably larger than others. This produces a very natural looking product. It is impossible to obtain any such product by using a single end of yarn as a starting material, and for that reason it is a highly important and critical feature of this invention to begin the process with a tow having a very substantial number of filaments, which tow is spread out into the form of a thin ribbon, and which is cut into flock size while in the form of a spread-out ribbon. When the ribbon is broken up into a random distribution of splinters of various deniers, the product has a very natural and pleasing appearance.

It is possible, of course, to attempt to duplicate the random nature and distribution of bundles that is obtained by using tow as a starting material, by providing predetermined blends of different-count yarns or blends of different total denier yarns, but this involves excessive expense, annoyance and difficulty, not only in blending the yarns and presenting them in the form of a two, but also in maintaining inventories of different sizes or deniers of yarns, at excessive unit cost.

It is possible to utilize, of course, 100 percent flocked splinters and no individual flock fibres. However, this may be varied widely. The percentage of splinters may be as low as 10% or even lower, and the percentage of individual flocked fibres may, of course, be anywhere within the range of 0 to 90% by weight. However, it is highly preferred to utilize at least about 40% of flocked splinters, since this provides a sharply superior natural appearance. In this case, the percentage of flocked splinters is in the range of 40 to 100% and the content of individual flocked fibres is in the range of about 0 to 60% by weight.

It will be appreciated that different materials may be utilized in combination with each other. For example, nylon and rayon tow may be mixed with each other, and bundled together by the application of size, and then co-flocked as a bundle followed by removal of the size. Further, this may be accomplished with any other combination of two or more different fibres.

The operation of the electrostatic flocking chamber is essentially the same as it has been in the past, with the flocking of individual fibres. Either AC or DC flocking may be used, but in many cases particularly when the splinter denier is relatively high, it is sometimes preferable to use a higher voltage in the electrostatic flocking chamber.

This invention has a further advantage in that some of the very light denier per filament fibres are difficult or impossible to flock in a standard electrostatic flocking chamber. For example, 2½ denier per filament flock fibres beyond a length of about 0.050" to 0.060" tend to kink, curl, and twist in the course of the electrostatic flocking operation. By way of contrast, splintered bundles of 2.5 denier filament rayon can be processed up to 0.400" without curl or poor sifting qualities.

Still another advantage in accordance with this invention is that the product, such as that shown in FIG. 3 for example, has a substrate S which has a rather large area that is unoccupied by any flock fibres. This is in contrast to a standard flocked substrate, in which the individual fibres are substantially uniformly distributed over the entire surface of the substrate. Because of the air spaces or voids between the bases of the splinter groups in accordance with this invention, the base fabric is far more flexible and produces a better product.

As used in connection with this invention, the term "tow" is intended to include an elongated bundle of filaments arranged substantially parallel to each other, having a reasonably uniform thickness along its length. The filaments may either be continuous or discontinuous, the same as each other or a blend of different fibres, of the same or different denier, and may include natural fibres or synthetic fibres alone, or synthetic fibres blended with natural fibres. Although the most frequently used form of tow is a continuous filament tow, this invention may be utilized as well with garnetted waste, piddled filament waste yarns, garnetted sliver filaments and natural fibres, carded sliver, braided or twisted rope and the like, provided that the aggregation of fibres is spread out in the form of a flat ribbon, as heretofore disclosed. The tow, of course, may be of any denier at all. With smaller deniers such as 10,000 or less it is possible to obtain splinters which are quite thin as compared to their width, and with deniers of 250,000 to 500,000 or more, each splinter may be considerably thicker in comparison to its width.

Although this invention has been described with reference to specific embodiments thereof, it will be appreciated that various other modifications may be made, including the substitution of equivalent components or method steps in substitution for those shown and described. Further, the invention comprehends the use of certain features independently of other features, reversals of parts and the substitution of equivalent elements, all of which modifications may be made without departing from the spirit and scope of the invention as defined in the appended claims.

The following is claimed:

1. In a method of making a splinter-flocked fabric, the steps which comprise:

(a) arranging a multifilament tow in the form of a wide, flat, thin ribbon, with the filaments of the tow closely adjacent and substantially parallel to intimately mixed individual filaments, (b) temporarily adhering the filaments of said tow to each other while in the form of a wide, flat ribbon and while substantially parallel to each other by the application of a temporary adhesive, (c) cutting the tow while in the form of a wide, flat thin ribbon into flock fibre lengths while said fibres are adhered and substantially parallel to each other, to form elongated flat, thin flock fibre bands, each said band comprising a plurality of substantially parallel cut fibres which are temporarily adhered by adhesive bands substantially parallel to each other in the form of elongated, flat fibre bands, (d) controllably breaking up some of the adhesive bands of said bands to form said bands into a multiplicity of elongated, thin flat splinters of controlled denier, each said splinter comprising cut fibres temporarily adhered substantially parallel to each other, the number of fibres in each splinter being more than one but less than the number of fibres in the corresponding band, (e) flocking said splinters by adhering them with an adhesive layer on a substrate, while maintaining said splinters as elongated thin flat structural units, controlling the rate of feed of said flock splinters with respect to the rate of feed of said substrate in a manner to space said splinters farther from each other than the spacing that exists between the individual fibres of the splinter, and (f) removing said temporary adhesive but not said adhesive layer.

2. The method defined in claim 1, wherein said step of breaking up the bands comprises rubbing a plurality of said bands gently against each other.

3. The method defined in claim 1, wherein said bands are broken up to form flock splinters having total fibre deniers per splinter in the range of about 30 to 450.

4. The method defined in claim 3, wherein said fibres have a denier per fibre of about 30 to 450 and fibre lengths of 0.1 to 0.4 inches.

5. The method defined in claim 1, wherein the initial tow is rope-like in form, and wherein it is fanned out to form said wide, flat ribbon.

6. The method defined in claim 1, wherein said bands are broken up into flock splinters by beating.

7. The method defined in claim 1, wherein said flock splinters are electrostatically deposited upon said substrate in combination with a plurality of individual flock fibres.

8. The method defined in claim 1, wherein said temporary adhesive is size, and wherein said size is removed in step (f) by washing with water.

9. The method defined in claim 1, wherein said flock splinters are composed of a mixture of fibres of different types.

10. The method defined in claim 1, wherein said flock splinters are composed of a mixture of fibres of different colors.

11. The method defined in claim 1, wherein individual flock fibres are co-flocked with said splinters in step (e).

12. The method defined in claim 1 including the steps of successively flocking individual fibres and splinters in separate steps upon said substrate.

13. In a method of making a splinter-flocked fabric, the steps which comprise:

(a) arranging a multifilament tow in the form of a wide, flat, thin ribbon, with the filaments of the tow closely adjacent and substantially parallel to intimately mixed individual filaments, (b) temporarily adhering the filaments of said tow to each other while in the form of a wide, flat ribbon and while substantially parallel to each other by the application of a temporary adhesive, (c) drying said tow, (d) cutting the dried tow while in the form of a wide, flat thin ribbon into flock fibre lengths while said fibres are adhered and substantially parallel to each other, to form elongated flat, thin flock fibre bands, each said band comprising a plurality of substantially parallel cut fibres which are temporarily adhered by adhesive bands substantially parallel to each other in the form of elongated, flat fibre bands, (e) controllably breaking up some of the adhesive bands of said bonds to form said bands into a multiplicity of elongated, thin flat splinters of controlled denier, each said splinter comprising cut fibres temporarily adhered substantially parallel to each other, the number of fibres in each splinter being more than one but less than the number of fibres in the corresponding band, (f) electrostatically flocking said splinters and maintaining the splinters as elongated units, (g) adhering said splinters with an adhesive layer on a substrate, while maintaining said splinters as elongated thin flat structural units, controlling the rate of feed of said flock splinters with respect to the rate of feed of said substrate in a manner to space said splinters farther from each other than the spacing that exists between the individual fibres of the splinter, and (h) removing said temporary adhesive but not said adhesive layer.

* * * * *

UNITED STATES PATENT OFFICE

CERTIFICATE OF CORRECTION

PATENT NO. : 4,147,813
DATED : April 3, 1979
INVENTOR(S) : James P. Casey

It is certified that error appears in the above-identified patent and that said Letters Patent are hereby corrected as shown below:

Col. 1, line 7, delete "January 25, 1975" and insert therefor --January 29, 1975--.

Col. 5, line 27, delete "on-uniform" and insert therefor --non-uniform--.

Col. 7, line 20, delete the first occurrence of "bands" and substitute therefor --bonds--.

Col. 8, line 37, delete the first occurrence of "bands" and substitute therefor --bonds--.

Col. 8, line 37, delete "bonds" and substitute therefor --bands--.

Signed and Sealed this

*Twenty-fourth* Day of *July 1979*

[SEAL]

*Attest:*

*Attesting Officer*

LUTRELLE F. PARKER

*Acting Commissioner of Patents and Trademarks*